US006658693B1

(12) United States Patent
Reed, Jr.

(10) Patent No.: US 6,658,693 B1
(45) Date of Patent: Dec. 9, 2003

(54) HAND-HELD EXTRACTION CLEANER WITH TURBINE-DRIVEN BRUSH

(75) Inventor: Charles A. Reed, Jr., Rockford, MI (US)

(73) Assignee: Bissell Homecare, Inc., Grand Rapids, MI (US)

( * ) Notice: Subject to any disclaimer, the term of this patent is extended or adjusted under 35 U.S.C. 154(b) by 58 days.

(21) Appl. No.: 09/975,181

(22) Filed: Oct. 11, 2001

Related U.S. Application Data

(60) Provisional application No. 60/239,670, filed on Oct. 12, 2000.

(51) Int. Cl.[7] ..... A47L 5/24
(52) U.S. Cl. ..... 15/321; 15/344; 15/387
(58) Field of Search ..... 15/321, 344, 387, 15/320

(56) References Cited

U.S. PATENT DOCUMENTS

| | | | | |
|---|---|---|---|---|
| 3,849,823 A | | 11/1974 | Adamson et al. | |
| 4,167,798 A | | 9/1979 | Klugl et al. | |
| 4,305,176 A | | 12/1981 | Lessig, III et al. | |
| 4,589,161 A | | 5/1986 | Kochte et al. | |
| 4,776,058 A | | 10/1988 | Garner et al. | |
| 4,798,613 A | * | 1/1989 | Hetherington et al. | 95/267 |
| 5,249,333 A | | 10/1993 | Worwag | |
| 5,367,740 A | * | 11/1994 | McCray | 15/320 |
| 5,386,612 A | * | 2/1995 | Sham | 15/320 |
| 5,443,362 A | | 8/1995 | Crites et al. | |
| 5,493,752 A | * | 2/1996 | Crouser et al. | 15/321 |
| 5,701,633 A | * | 12/1997 | Jonischus | 15/387 |
| 5,752,289 A | | 5/1998 | Collins | |
| 5,867,864 A | | 2/1999 | Miller et al. | |
| 6,073,300 A | * | 6/2000 | Zahuranec et al. | 15/320 |
| 6,125,498 A | | 10/2000 | Roberts et al. | |
| 6,134,746 A | * | 10/2000 | Miller et al. | 15/387 |
| 6,167,586 B1 | * | 1/2001 | Reed et al. | 15/320 |
| 6,347,428 B1 | * | 2/2002 | Shimko et al. | 15/320 |

FOREIGN PATENT DOCUMENTS

JP 2000-201874 * 7/2000

* cited by examiner

*Primary Examiner*—Terrence R. Till

(57) ABSTRACT

The invention relates to a hand-held extraction cleaner including a cleaning fluid supply system for supplying a cleaning fluid to a surface, a dirt recovery system including a source of suction fluidly connected to the surface through a cleaning fluid recovery tank assembly, and a rotary agitation brush for agitating the surface to be cleaned. The brush is driven by air-powered turbine assembly fluidly connected between ambient air and the suction source.

14 Claims, 7 Drawing Sheets

HAND-HELD EXTRACTION CLEANER WITH TURBINE-DRIVEN BRUSH

CROSS REFERENCE TO RELATED APPLICATIONS

This application claims the benefit of U.S. Provisional Application Serial No. 06/239,670, filed Oct. 12, 2000.

BACKGROUND OF THE INVENTION

1. Field of the Invention

The invention relates to extraction cleaners. In one of its aspects, the invention relates to a portable hand-held extraction cleaner with an agitation brush. In another of its aspects, the invention relates to a portable hand-held extraction cleaner with a turbine-driven agitation brush. In another of its aspects, the invention relates to a portable hand-held extraction cleaner with a removable recovery tank and a motor-driven agitation brush.

2. Description of the Related Art

Portable, hand-held extraction cleaners having a cleaning solution supply tank and a recovery tank are known. These extraction cleaners typically have a vacuum motor that powers an impeller to create low pressure on one side of the impeller and higher pressure on the other side thereof. The recovery tank is typically positioned between the low-pressure side of the impeller and a fluid collection nozzle to remove fluid from a surface and deposit it in the recovery tank. It is also known to provide a separate cleaning solution pump for directing cleaning solution from the supply tank to the surface.

One hand-held extraction cleaning device is disclosed in U.S. Pat. No. 4,788,738 issued to Monson et al. on Dec. 6, 1988. In this arrangement, a hand-held extraction cleaner has a handle section removably joined to a lower discharge section. A collection chamber receives fluid from a surface through a nozzle opening that communicates with the intake side of a vacuum motor. The collection tank houses a hollow plenum chamber and a centrifugal separator attached to a vacuum blower. A cleaning-fluid tank is pressurized by exhaust air from the outlet side of the rotating vacuum blower to force cleaning fluid under pressure from the cleaning fluid tank to a supply nozzle when a solution supply trigger is depressed to thereby apply cleaning fluid to a surface.

U.S. Pat. No. 5,367,740 issued to McCray on Nov. 29, 1994, discloses a hand-held extraction cleaner that includes a housing, a handle, a body portion, and a nozzle with a suction opening. A collection tank is removably supported on the housing and is fluidly connected through a separator to a vacuum pump. The vacuum pump has an exhaust port and is powered by an electric pump motor. A solution tank is removably connected to the housing and is pressurized by a pressure pump that is also connected to the pump motor. A separate drive motor is coupled to a rotatable brush for scrubbing a surface to be cleaned.

U.S. Pat. No. 4,305,176 issued to Lessig, III et al. on Dec. 15, 1981, discloses an air-powered vacuum cleaner floor tool including a housing having an air-powered turbine motor and a rotary floor agitator. The rotary floor agitator is coupled to and driven by the turbine motor.

U.S. Pat. No. 5,867,864 issued to Miller et al. on Feb. 9, 1999, discloses a hand-held extractor nozzle having a pair of rotary scrub brushes, each having a vertical axis, and powered by an air turbine having an ambient air inlet and an outlet in communication with a suction tube.

U.S. Pat. No. 6,125,498 issued to Roberts et al. on Oct. 3, 2000, and having common ownership with this application, discloses a hand-held extraction cleaner including a cleaning fluid supply system for supplying a cleaning fluid to a surface and a fluid recovery system including a source of suction fluidly connected to the surface through a cleaning fluid recovery tank assembly. This patent is hereby incorporated by reference in its entirety.

SUMMARY OF THE INVENTION

A hand-held liquid extraction cleaner for cleaning a surface comprises a cleaner housing, a liquid extraction system including a vacuum source mounted to the cleaner housing, a liquid dispensing system mounted to the cleaner housing, a rotatably mounted agitation brush for agitating the surface to be cleaned and a motor operably connected to the agitation brush for rotatably driving the brush. According to the invention, the motor is a turbine motor that is operably connected to the vacuum source for driving the turbine motor with the vacuum source and the cleaner housing, the liquid extraction system, the liquid dispensing system, the agitation brush, and the motor constitute a unit that can be carried and operated with a single hand.

The liquid extraction cleaner is of the type in which a handle is mounted on the cleaner housing to facilitate carrying and operating the unit during use.

In a preferred embodiment, the recovery tank is removably mounted to the cleaner housing. The agitation brush is mounted to the recovery tank for rotation with respect thereto. Further, in a preferred embodiment, the turbine motor is also mounted to the recovery tank so that the agitation brush and turbine motor are removable with the recovery tank from the cleaner housing.

The liquid extraction system includes a recovery tank that has an inlet opening at an upper portion thereof and is connected through a suction conduit to a vacuum source for delivery of liquid and debris from the suction nozzle into the recovery tank.

Further according to the invention, a hand-held liquid extraction cleaner has a cleaner housing, a liquid extraction system mounted to the cleaner housing, a liquid dispensing system, a rotatably mounted brush for agitating the surface to be cleaned and a motor operably connected to the brush for rotatably driving the brush. The brush is mounted to the recovery tank for rotation with respect thereto. Preferably, the motor is also mounted to the recovery tank. Typically, a handle on the cleaner housing is adapted for carrying and manipulating the extraction cleaner during use.

The liquid extraction system used in the various embodiments of the invention typically includes a suction nozzle having a nozzle opening, a recovery tank with an inlet opening and a vacuum source. The vacuum source is in open communication with the recovery tank, the suction conduit and the suction nozzle whereby the vacuum source can draw liquid and debris through the suction nozzle and the suction conduit and to the recovery tank in which the liquid and debris are deposited.

The liquid dispensing system used in the various embodiments of the invention is of the type which has a cleaning fluid supply tank, at least one spray nozzle having an outlet opening for spraying cleaning fluid onto the surface to be cleaned and a supply conduit interconnecting the cleaning fluid supply tank and the spray nozzle for supplying cleaning fluid to the spray nozzle. A pump, of the electrical or hand type, can be used for pressurizing the cleaning fluid in the supply conduit.

The agitation brush used in the various embodiments of the invention a is the type which is mounted for rotation with respect to the cleaner housing, preferably on the recovery tank. The agitation brush can rotate about a horizontal axis or about a vertical axis. Either type of brush can be powered by a turbine motor.

BRIEF DESCRIPTION OF THE DRAWINGS

The invention will now be described with reference to the drawings in which.

DETAILED DESCRIPTION OF THE PREFERRED EMBODIMENT

Figure 1:
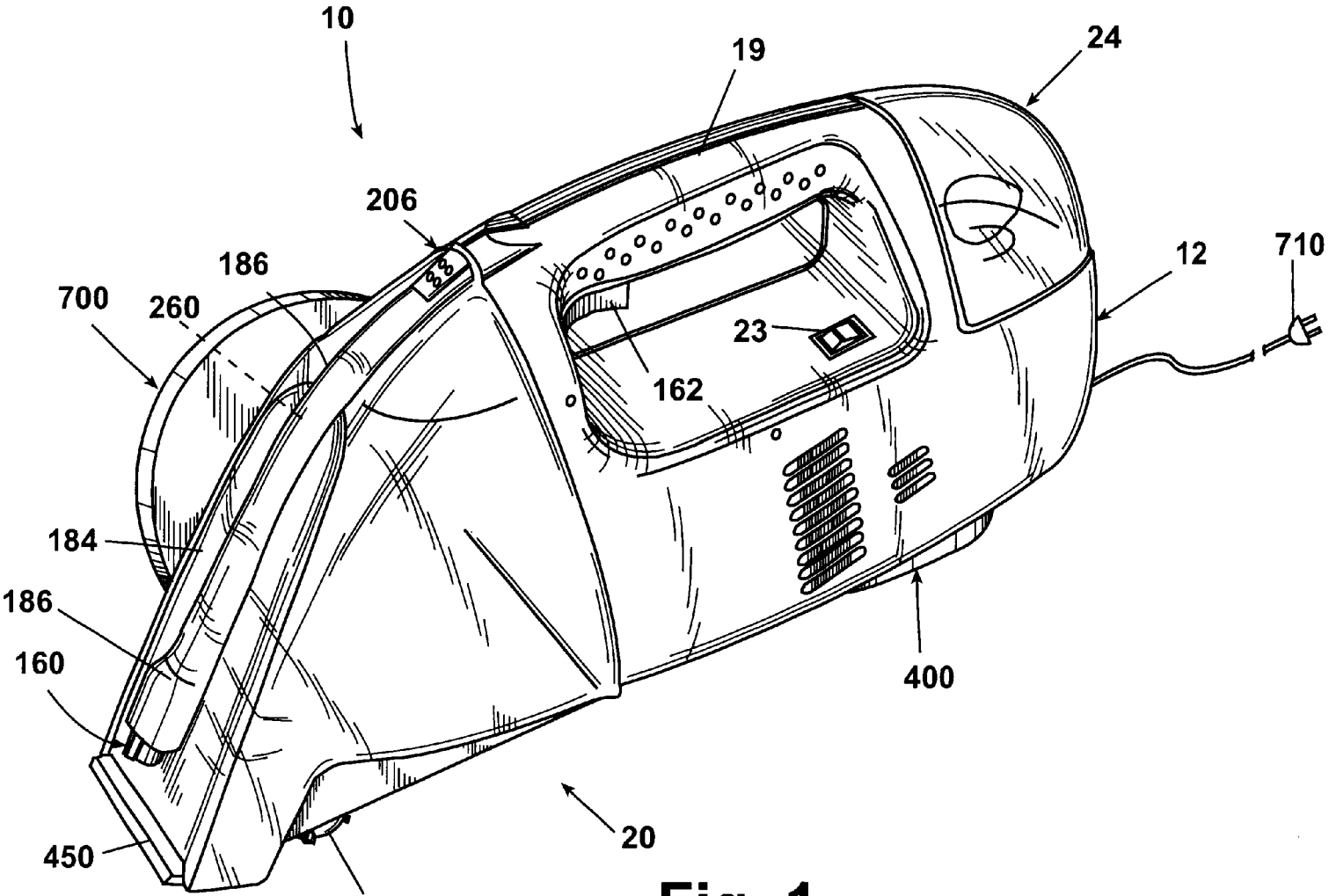
FIG. 1 is a perspective view of a hand-held extraction cleaner with turbine-driven brush according to the invention.

With reference to the FIGS. 1–4, a hand-held extraction cleaner with turbine-driven brush 10 according to the invention comprises a housing 12 having a handle portion 19, a removable cleaning fluid supply tank 24, recovery tank assembly 20, and power cord 710. Those features of the hand-held extraction cleaner 10 not expressly discussed herein are further disclosed in U.S. Pat. No. 6,125,498, commonly owned with this application and incorporated herein by reference in its entirety.

Figure 3:
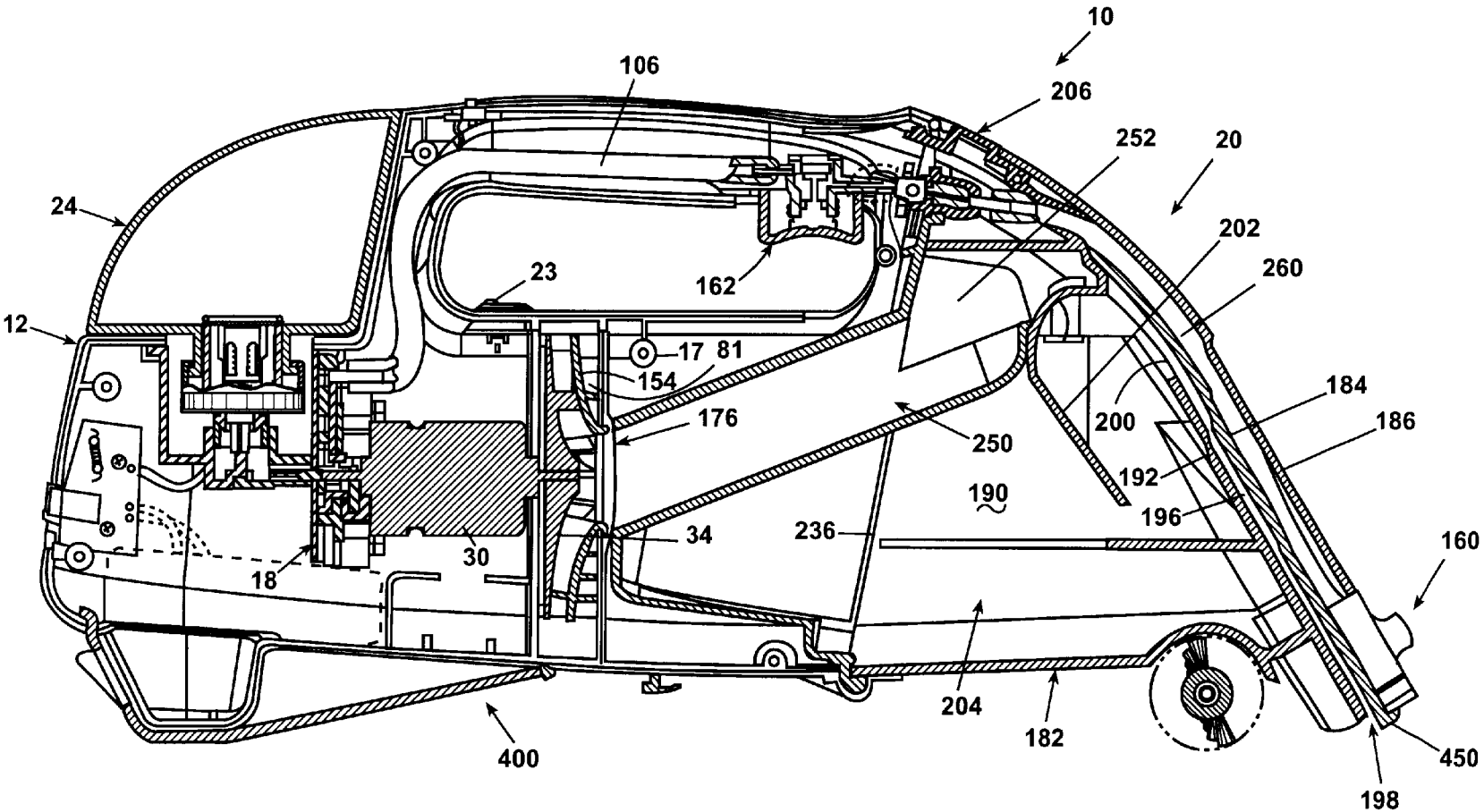
FIG. 3 is a cross-sectional view of the hand-held extraction cleaner taken through line 3—3 of FIG. 2.

Referring to FIG. 3, the hand-held extraction cleaner 10 according to the invention includes a solution-dispensing system and a solution-recovery system. The solution-dispensing system and the solution-recovery system are both powered by an electric motor 30. The motor 30 drives a pump assembly 18 for pumping the cleaning solution and an impeller 34 for developing suction in the solution-recovery system. The electric motor 30 is controlled by an on/off switch 23. The motor can be a direct-current motor powered by rechargeable batteries carried within the housing 12, or an alternating-current motor of known construction supplied power from an external source through the power cord 710 (FIG. 1).

The solution-dispensing system comprises a cleaning solution supply tank 24 fluidly connected through the pump assembly 18 and fluid supply conduit 106 to a trigger mechanism 162. Actuation of the trigger mechanism 162 releases the fluid to a tube 260 for dispensing by a spray nozzle assembly 160 onto a surface being cleaned. The tube 260 is encased within a nozzle cover 186 on a forward portion of the hand-held extraction cleaner 10. The spray nozzle assembly 160 is assembled to a lower end of the nozzle cover 186. The nozzle cover 186 is assembled onto a channel cover 184 on the front face 192 of the recovery tank assembly 20.

The channel cover 184 and front face 192 form a suction conduit 196. A lower end of the suction conduit 196, behind the lower lip 450 of channel cover 184, forms a suction nozzle opening 198 positioned for placement proximate a surface being cleaned. The suction nozzle opening 198 is fluidly connected through the suction conduit 196 and an inlet opening 200 to the interior chamber 204 of the recovery tank assembly 20. The interior chamber 204 is further fluidly connected to the impeller 34 through air conduit 250.

In operation, the user turns on the motor 30 by switch 23 to develop pressure in the cleaning solution-dispensing system and a suction force within the solution-recovery system. The user then dispenses cleaning solution onto the surface being cleaned by actuation of trigger mechanism 162 and can agitate the surface using agitation brush 705. The dispensed solution is drawn into suction nozzle opening 198 by the suction force in the recovery tank assembly 20. The recovered solution is drawn through inlet opening 200 and deposited into the bottom of the interior chamber 204. The solution is deflected downwardly by deflector 202. Air conduit 250 has a first open end 252 in an upper region of the chamber 204. Deflector 205 and open end 252 cooperate to prevent fluid from being drawn into impeller 34. Air drawn in by the suction force thus passes free of liquid through the air conduit 250 to the impeller 34 and is exhausted to the atmosphere.

Figure 2:
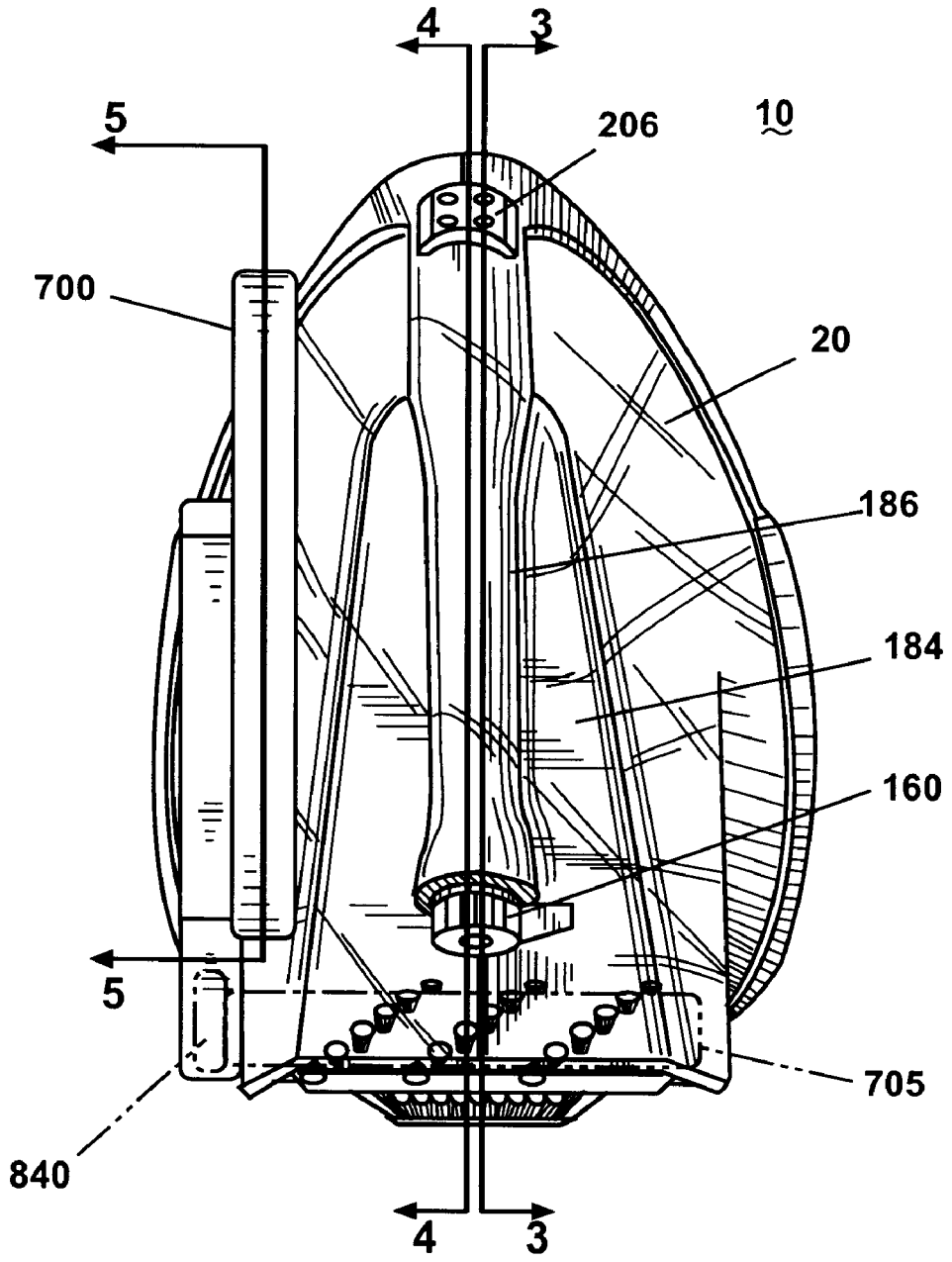
FIG. 2 is a front view of the cleaner of FIG. 1.
Figure 4:
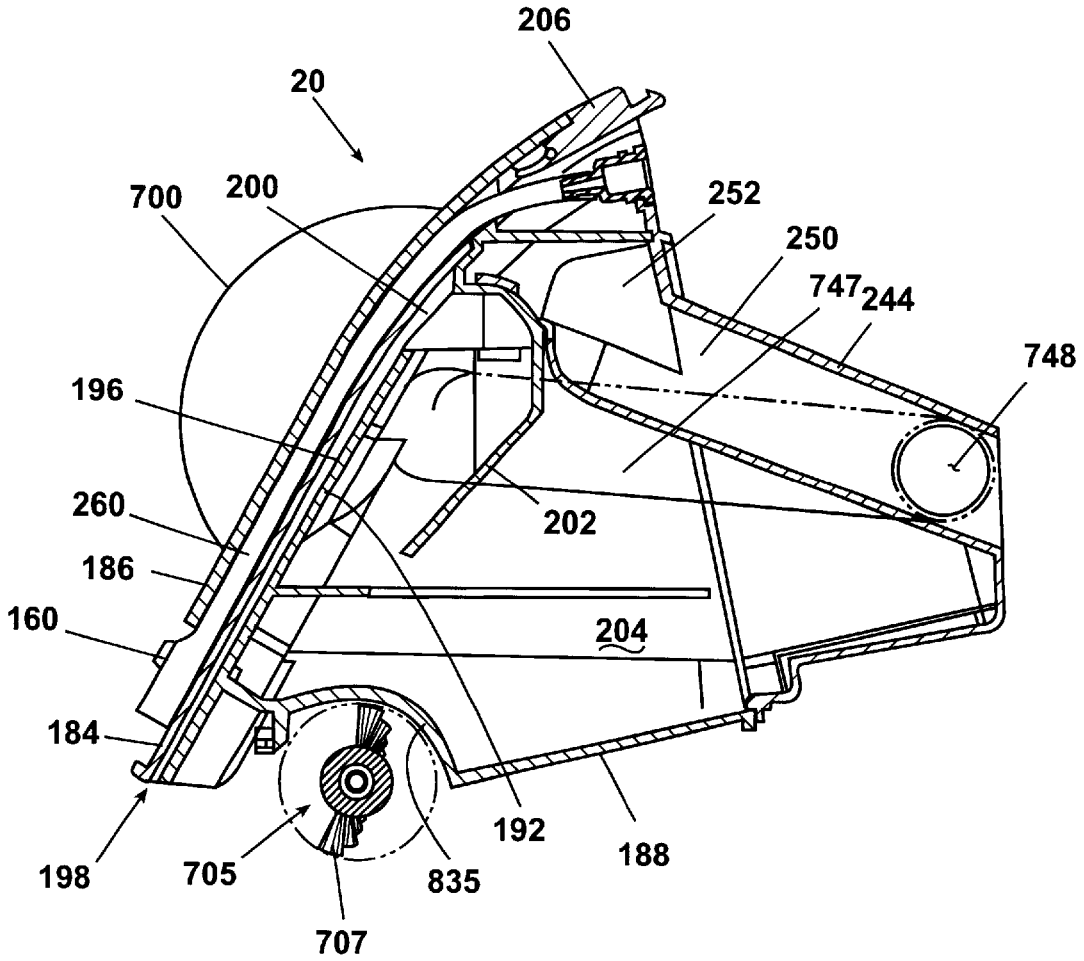
FIG. 4 is a cross-sectional view of the recovery tank assembly taken through line 4—4 of FIG. 2.

Referring now to FIGS. 2 and 4, the recovery tank assembly 20 further comprises a turbine assembly 700 and rotatable agitation brush 705. The turbine assembly 700 includes a turbine air conduit 747 fluidly connected to air conduit 250 through the turbine air outlet 748. The turbine assembly 700 is thus fluidly connected to the impeller 34.

Agitation brush 705 is rotatably mounted to the recovery tank assembly 20, parallel to a bottom wall 188 of the tank assembly 20. It is thereby positioned to be parallel to a surface being cleaned so that as the brush 705 rotates, bristles 707 agitate the surface to effectuate dirt removal. The recovery tank assembly 20 is removably mounted to the housing 12 and is removable by depressing latch 206 and rotating recovery tank assembly 20 in a forward and downward direction.

Figure 5:
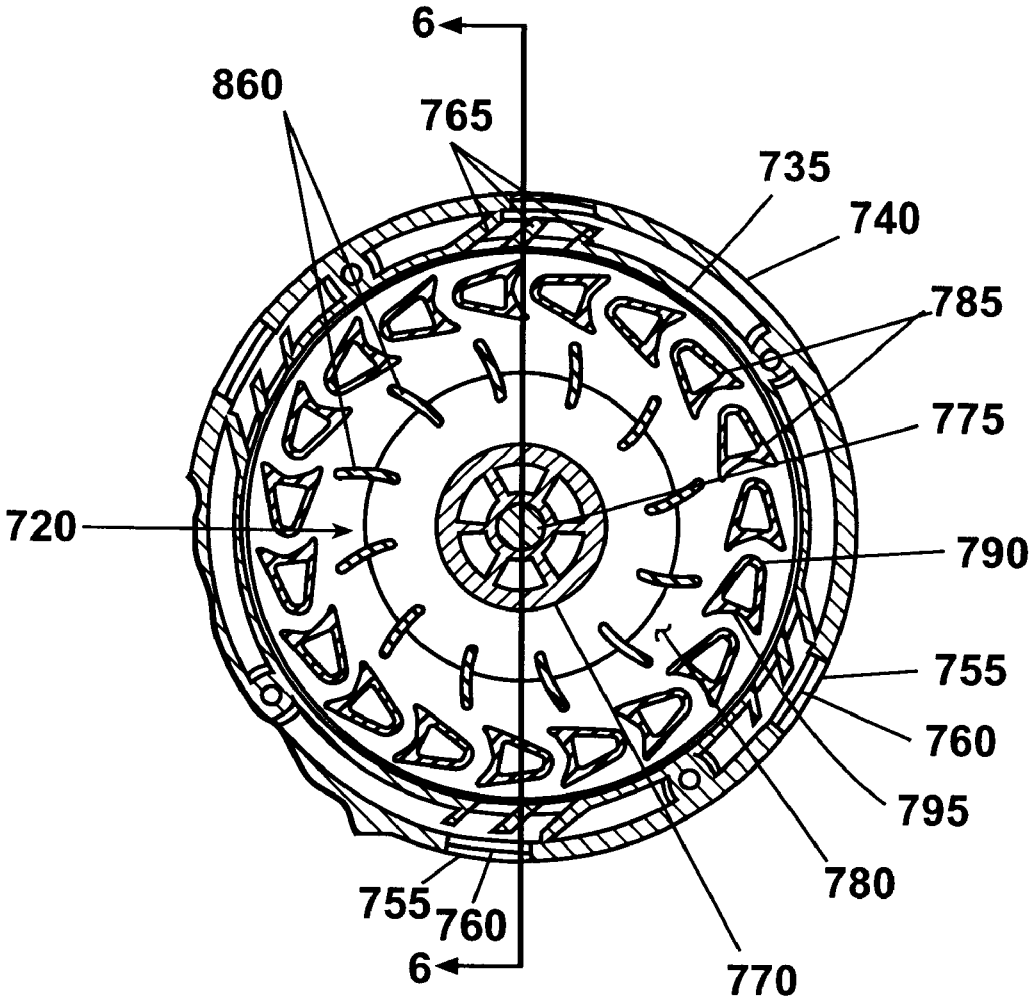
FIG. 5 is a cross-sectional view of the turbine housing taken through line 5—5 of FIG. 2.
Figure 6:
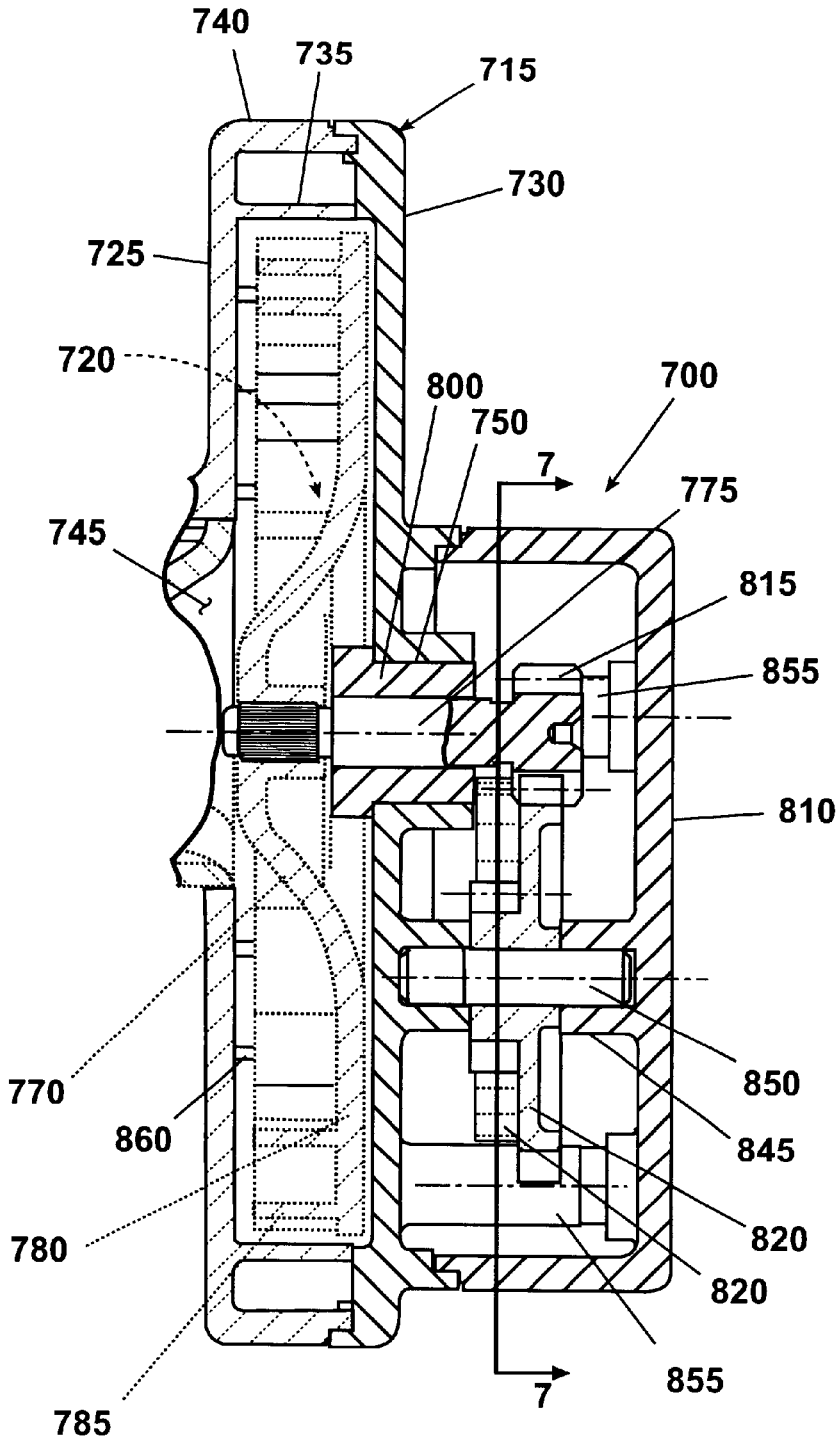
FIG. 6 is a cross-sectional view taken through line 6—6 of FIG. 5.
Figure 7:
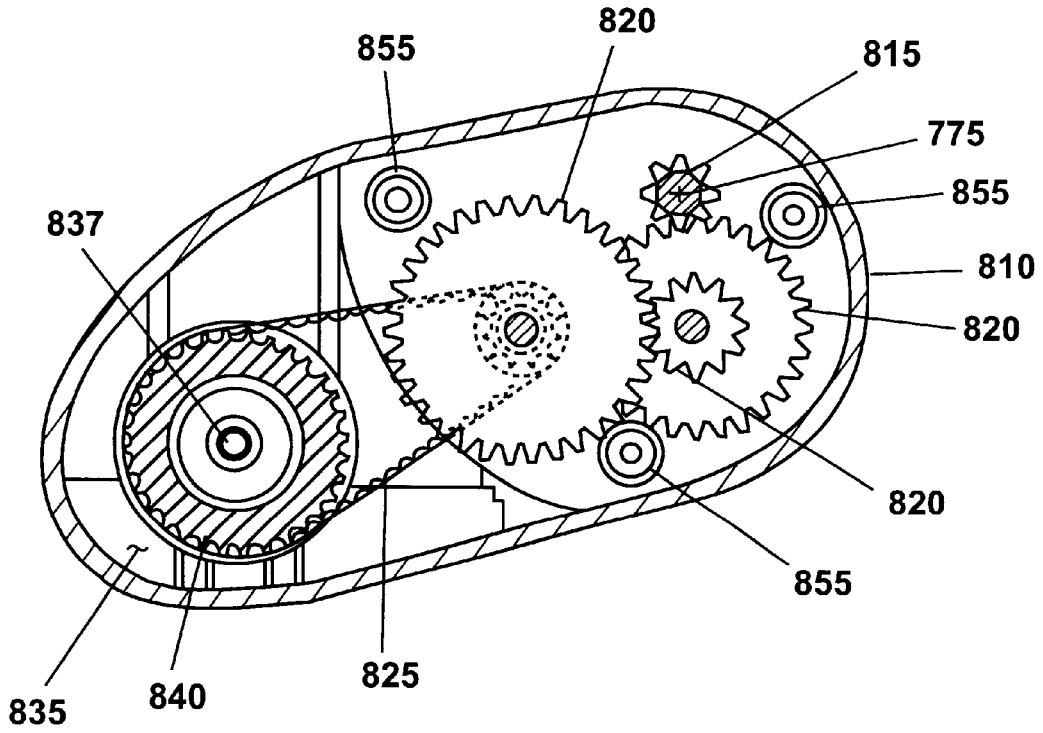
FIG. 7 is a cross-sectional view taken through line 7—7 of FIG. 6.

Referring now to FIGS. 5–7, the turbine assembly 700 comprises a turbine housing 715 and a gear housing 810. The turbine housing 715 encloses a turbine 720 therein and the gear housing 810 encloses a plurality of intermediate gears 820.

The turbine housing 715 comprises parallel inner and outer walls 725, 730 connected about their perimeter by annular inner and outer sidewalls 735, 740. The inner wall 725 has a central air outlet 745 fluidly connected to turbine air conduit 747, and the outer wall 730 has a central axis aperture 750. The outer sidewall 740 includes a number of spaced air inlet apertures 755, each aperture 755 covered with a screen 760.

Turbine housing 715 is fluidly connected with a source of suction (impeller 34) within the interior of the recovery tank assembly 20 through central air outlet 745 and turbine air conduit 747. Turbine housing 715 is further fluidly connected to the atmosphere through air inlet apertures 755.

The inner sidewall 735 of turbine housing 715 includes a number of angled vanes 765. Vanes 765 are colocated and aligned with the air inlet apertures 755 of the outer sidewall 740 about the perimeter of the housing 715. Vanes 765 are perpendicular to the inner and outer walls 725, 730, and are oriented in the same angular relationship with respect to a radial line extending from the center of the turbine housing 715 to the inner sidewall 735. The vanes 765 thereby direct air drawn through the inlet apertures 755 in one substantially tangential direction about the perimeter of the housing 715. In lieu of, or in addition to, the apertures 755 in the outer sidewall 740 of the housing 715, apertures can be placed in the parallel inner and/or outer sidewalls 735, 740.

Turbine 720 comprises a central hub 770 and an annular disk 780 integrally formed with the central hub 770 and concentric therewith. An axle 775 is press-fit in the center of the central hub 770. Axle 775 is rotatably received in a bushing 800 that is press-fit in the axis aperture 750 of the outer wall 730, centering the turbine 720 within the housing 715.

Annular disk 780 defines a plane perpendicular to the axle 775. The disk 780 includes a plurality of fins 785 about its perimeter. The fins 785 stand perpendicular to the disk 780, and include a rounded leading face 790 and a concave trailing face 795. The fins 785 are arranged in a line about the perimeter of the disk 780 so that the leading face 790 of one fin 785 is aligned with the trailing face of the next fin 785. Alternate blade shapes, such as straight radial blades, can be used in lieu of the fins 785.

With turbine 720 centered within housing 715, disk 780 is oriented parallel to the outer wall 730 with fins 785 perpendicular to the outer wall 730. The fins 785 are aligned about the perimeter of the disk 780, forming a plane generally parallel to the inner sidewall 735. The concave trailing faces 795 are arranged about the perimeter of the disk 780 and are oriented so that air passing through vanes 765 will impinge upon trailing faces 795 to impart rotational motion to turbine 720.

Axle 775 passes through the bushing 800 and into gear housing 810 received on an outer portion of the turbine housing 715. A portion of the outer wall 730 of the turbine housing 715 forms the inner wall of the gear housing 810. Axle 775 includes at an outer end thereof within the gear housing 810, a turbine gear 815. Gear housing 810 further encloses a plurality of intermediate gears 820, and a drive belt 825. The drive belt 825 can be replaced with additional gears. Turbine gear 815 and intermediate gears 820 are oriented so that the teeth of the gears 815, 820 mesh to translate rotational movement from one gear to another. The drive belt 825 has teeth for meshing with the teeth of one of the intermediate gears 820, and passes from the gear housing 810 to a brush housing 835 (FIG. 4).

The drive belt 825 further meshes with a brush drive gear 840 in the brush housing 835. The brush drive gear 840 is operably connected to the agitation brush 705, and the combination is rotatably mounted to the recovery tank assembly 20 and brush housing 835 by way of a bushing 837 fixed to the brush housing 835.

The interior of the gear housing 810 is generally of molded construction, including bosses 845 for receiving spindles 850 on which the gears 820 are rotatably mounted. The spindles 850 can be integrally molded to the gear housing 810. The interior of the gear housing 810 further includes molded bosses 855 for receiving screws (not shown) for mounting the gear housing 810 to the turbine housing 715.

In operation, the source of suction (impeller 34) is activated, creating a suction force within the recovery tank assembly 20 and creating a suction at the turbine air outlet 748. The suction force draws ambient air through air inlet apertures 755 due to the fluid connection of turbine air outlet 748 to air inlet apertures 755 through turbine housing 700, central air outlet 745, and turbine air conduit 747. Vanes 765 in the inner sidewall 735 impart a tangential component to the inlet air to direct the inlet air against the concave trailing face 795 of the fins 785. The force of the inlet air against the fins 785 causes the turbine 720 to rotate with axle 775, the axle 775 rotating within the bushing 800. The inlet air then passes over a plurality of arcuate vanes 860 formed in the inner wall 725 of the turbine housing 715 so as to direct the air from the fins 785 toward the central air outlet 745 and into the recovery tank assembly 20.

With particular reference to FIG. 7, as axle 775 rotates, its rotational motion is transferred through turbine gear 815 to intermediate gears 820. Intermediate gears 820 are operably connected to brush drive gear 840 through drive belt 825. Agitation brush 705 is thus rotatably driven relative to the recovery tank assembly 20. Bristles 707 of agitation brush 705 can be applied to a surface being cleaned.

Reasonable variation and modification are possible within the spirit of the foregoing specification and drawings without departing from the scope of the invention which is defined in the appended claims.

What is claimed is:

1. A hand-held liquid extraction cleaner for cleaning a surface, the extraction cleaner comprising;

a cleaner housing;

a liquid extraction system mounted to the cleaner housing and including;

a suction nozzle having a nozzle opening;

a recovery tank having an inlet opening;

a suction conduit in communication with the suction nozzle and the inlet opening to the recovery tank; and a vacuum source in open communication with the recovery tank, the suction conduit and the suction nozzle, whereby the vacuum source can draw liquid and debris through the suction nozzle and the suction conduit and to the recovery tank into which the liquid and debris are deposited;

a liquid dispensing system mounted to the cleaner housing and including;

a cleaning fluid supply tank;

at least one spray nozzle having an outlet opening for spraying cleaning fluid onto the surface to be cleaned; and a supply conduit interconnecting the fluid supply tank and the spray nozzle for supplying cleaning fluid to the spray nozzle;

a rotatably mounted agitation brush for agitating the surface to be cleaned; and a motor operably connected to the agitation brush for rotatably driving the agitation brush;

wherein the motor is a turbine motor that is operably connected to the vacuum source for driving the turbine motor with the vacuum source and wherein the cleaner housing, the liquid extraction system, the liquid dispensing system, the agitation brush, and the motor constitute a unit that can be carried and operated by a single hand.

2. A hand-held liquid extraction cleaner according to claim 1 and further comprising a handle on the cleaner housing to facilitate carrying and operating the unit during use.

3. A hand-held liquid extraction cleaner according to claim 1 wherein the recovery tank is removably mounted to the cleaner housing.

4. A hand-held liquid extraction cleaner according to claim 1 wherein the recovery tank inlet opening is at an upper portion of the recovery tank.

5. A hand held liquid extraction cleaner according to claim 1 wherein the agitator brush rotates about an axis parallel to the surface to be cleaned.

6. A band-held liquid extraction cleaner for cleaning a surface, the extraction cleaner comprising;

a cleaner housing;

a liquid extraction system mounted to the cleaner housing and including;

a suction nozzle having a nozzle opening;

a recovery tank removably mounted to the cleaner housing and having an inlet opening;

a suction conduit in communication with the suction nozzle and the inlet opening to the recovery tank; and a vacuum source in open communication with the recovery tank, the suction conduit and the suction nozzle, whereby the vacuum source can draw liquid and debris through the suction nozzle and the suction conduit and to the recovery tank into which the liquid and debris are deposited;

a liquid dispensing system mounted to the cleaner housing and including;

a cleaning fluid supply tank;

at least one splay nozzle having an outlet opening for spraying cleaning fluid onto the surface to be cleaned; and a supply conduit interconnecting the fluid supply tank and the spray nozzle for supplying cleaning fluid to the spray nozzle;

a rotatably mounted agitation brush for agitating the surface to be cleaned;

a motor operably connected to the agitation brush for rotatably driving the agitation brush; and a handle on the cleaner housing adapted for carrying and manipulating the extraction cleaner during use, wherein the motor is a turbine motor that is operably connected to the vacuum source for driving the turbine motor with the vacuum source, and wherein the agitation brush is mounted to the recovery tank for rotation with respect thereto.

7. A hand-held liquid extraction cleaner according to claim 6 wherein the turbine motor is mounted to the recovery tank.

8. A hand-held liquid extraction cleaner for cleaning a surface, the extraction cleaner comprising;

a cleaner housing;

a liquid extraction system mounted to the cleaner housing and including:

a suction nozzle having a nozzle opening;

a recovery tank having an inlet opening;

a suction conduit in communication with the suction nozzle and the inlet opening to the recovery tank; and a vacuum source in open communication with the recovery tank, the suction conduit and the suction nozzle, whereby the vacuum source can draw liquid and debris through the suction nozzle and the suction conduit and to the recovery tank into which the liquid and debris are deposited;

a liquid dispensing system mounted to the cleaner housing and including;

a cleaning fluid supply tank;

at least one spray nozzle having an outlet opening for spraying cleaning fluid onto the surface to be cleaned; and a supply conduit interconnecting the fluid supply tank and the spray nozzle for supplying cleaning fluid to the spray nozzle;

a rotatably mounted agitation brush for agitating the surface to be cleaned; and a motor operably connected to the agitation brush for rotatable driving the agitation brush;

wherein the motor is a turbine motor that is operably connected to the vacuum source for driving the turbine motor with the vacuum source, and wherein the turbine motor is mounted to the recovery tank.

9. A hand-held liquid extraction cleaner according to claim 8 wherein the agitation brush is mounted to the recovery tank for rotation with respect thereto.

10. A hand-held liquid extraction cleaner for cleaning a surface, the extraction cleaner comprising;

a cleaner housing;

a liquid extraction system mounted to the cleaner housing and including:

a suction nozzle having a nozzle opening;

a recovery tank having an inlet opening;

a suction conduit in communication with the suction nozzle and the inlet opening to the recovery tank; and a vacuum source in open communication with the recovery tank, the suction conduit and the suction nozzle, whereby the vacuum source can draw liquid and debris through the suction nozzle and the suction conduit and to the recovery tank into which the liquid and debris are deposited;

a liquid dispensing system mounted to the cleaner housing and including;

a cleaning fluid supply tank;

at least one spray nozzle having an outlet opening for spraying cleaning fluid onto the surface to be cleaned; and a supply conduit interconnecting the fluid supply tank and the spray nozzle for supplying cleaning fluid to the spray nozzle;

a rotatable mounted agitation brush for agitating the surface to be cleaned; and a motor operably connected to the agitation brush for rotatable driving the agitation brush;

wherein the motor is a turbine motor that is operably connected to the vacuum source for driving the turbine motor with the vacuum source and wherein the agitation brush is mounted to the recovery tank for rotation with respect thereto.

11. A hand-held liquid extraction cleaner for cleaning a surface, the extraction cleaner comprising;

a cleaner housing;

a liquid extraction system mounted to the cleaner housing and including;

a suction nozzle having a nozzle opening;

a recovery tank having an inlet opening;

a suction conduit in communication with the suction nozzle and the inlet opening to the recovery tank; and a vacuum source in open communication with the recovery tank, the suction conduit and the suction nozzle, whereby the vacuum source can draw liquid and debris through the suction nozzle and the suction conduit and to the recovery tank in which the liquid and debris are deposited;

a liquid-dispensing system mounted to the cleaner housing and including;

a cleaning fluid supply tank;

at least one spray nozzle having an outlet opening for spraying cleaning fluid onto the surface to be cleaned; and a supply conduit interconnecting the fluid supply tank and the spray nozzle for supplying cleaning fluid to the spray nozzle;

a rotatably mounted agitation brush for agitating the surface to be cleaned; and a motor operably connected to the agitation brush for rotatably driving the same;

wherein the agitation brush is mounted to the recovery tank for rotation with respect thereto.

12. A hand-held liquid extraction cleaner according to claim 11 wherein the motor is mounted to the recovery tank.

13. A hand-held liquid extraction cleaner according to claim 12 and further comprising a handle on the cleaner housing adapted for carrying and manipulating the extraction cleaner during use.

14. A hand-held liquid extraction cleaner according to claim 11 and further comprising a handle on the cleaner housing adapted for use in carrying and manipulating the extraction cleaner during use.

* * * * *